US009989304B2

(12) United States Patent
Evans et al.

(10) Patent No.: US 9,989,304 B2
(45) Date of Patent: Jun. 5, 2018

(54) METHOD FOR UTILIZATION OF LEAN BOIL-OFF GAS STREAM AS A REFRIGERANT SOURCE

(75) Inventors: Megan V. Evans, Houston, TX (US); Attilio J. Praderio, Humble, TX (US); Lisa M. Strassle, Ponca City, OK (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 2490 days.

(21) Appl. No.: 12/691,100

(22) Filed: Jan. 21, 2010

(65) Prior Publication Data

US 2010/0218551 A1 Sep. 2, 2010

Related U.S. Application Data

(60) Provisional application No. 61/146,209, filed on Jan. 21, 2009.

(51) Int. Cl.
*F25J 1/00* (2006.01)
*F25J 1/02* (2006.01)

(52) U.S. Cl.
CPC ..... *F25J 1/021* (2013.01); *F25J 1/004* (2013.01); *F25J 1/0022* (2013.01); *F25J 1/0045* (2013.01); *F25J 1/0052* (2013.01); *F25J 1/0085* (2013.01); *F25J 1/0087* (2013.01); *F25J 1/025* (2013.01); *F25J 1/0208* (2013.01); *F25J 1/0219* (2013.01); *F25J 1/0231* (2013.01); *F25J 1/0265* (2013.01); *F25J 1/0295* (2013.01); *F25J 2220/64* (2013.01); *F25J 2230/08* (2013.01); *F25J 2230/60* (2013.01); *F25J 2245/90* (2013.01)

(58) Field of Classification Search
CPC ..... F25J 1/0022; F25J 1/004; F25J 1/0055; F25J 1/0082; F25J 1/0085; F25J 1/0087; F25J 1/0208; F25J 1/0209; F25J 1/021; F25J 1/025; F25J 1/0045; F25J 1/0052; F25J 2220/64; F25J 2245/90
USPC ..... 62/611, 612
See application file for complete search history.

(56) References Cited

U.S. PATENT DOCUMENTS

| | | | | |
|---|---|---|---|---|
| 3,440,828 | A | 4/1969 | Pryor et al. | |
| 3,889,485 | A | 6/1975 | Swearingen | |
| 5,669,234 | A | 9/1997 | Houser et al. | |
| 5,950,453 | A | 9/1999 | Bowen et al. | |
| 6,658,890 | B1 * | 12/2003 | Hahn et al. | 62/611 |
| 6,658,892 | B2 | 12/2003 | Fanning et al. | |
| 7,866,184 | B2 * | 1/2011 | Eaton | 62/630 |
| 2004/0255616 | A1 * | 12/2004 | Maunder | F25J 1/0022 62/611 |
| 2005/0279133 | A1 | 12/2005 | Eaton | |
| 2006/0137391 | A1 * | 6/2006 | Baudat et al. | 62/611 |
| 2007/0283718 | A1 * | 12/2007 | Hulsey et al. | 62/612 |
| 2009/0217701 | A1 * | 9/2009 | Minta | F25J 1/0022 62/612 |
| 2010/0186445 | A1 * | 7/2010 | Minta | F25J 1/0022 62/606 |

* cited by examiner

*Primary Examiner* — Keith Raymond
(74) *Attorney, Agent, or Firm* — ConocoPhillips Company

(57) ABSTRACT

This invention relates to a system and method for liquefying natural gas. In another aspect, the invention concerns an improved liquefied natural gas facility employing a closed loop methane refrigeration cycle. In another aspect, the invention concerns the utilization of lean boil-off gas.

24 Claims, 3 Drawing Sheets

METHOD FOR UTILIZATION OF LEAN BOIL-OFF GAS STREAM AS A REFRIGERANT SOURCE

CROSS-REFERENCE TO RELATED APPLICATIONS

This application claims priority benefit under 35 U.S.C. Section 119(e) to U.S. Provisional Patent Ser. No. 61/146,209 filed on Jan. 21, 2009, the entire disclosure of which is incorporated herein by reference.

FIELD OF THE INVENTION

The present invention relates to a method and a system for liquefying natural gas. In another aspect, the invention concerns a liquefied natural gas facility employing a closed loop methane refrigeration cycle. In another aspect, the invention concerns the utilization of lean boil-off gas as a refrigerant source.

BACKGROUND OF THE INVENTION

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems).

A common closed loop LNG design utilizes a recirculating methane refrigerant derived from the feed gas. Utilizing recirculated methane refrigerant derived from the feed gas is acceptable when the feed gas is comprised primarily of 99 mole percent methane with insignificant amounts of heavier components. However, today plants around the world are designed for feed gas with less than 99 mole percent methane, rather containing significant amounts of ethane, propane and heavier components. A feed stream containing heavy components as well as methane is problematic because the heavies will tend to accumulate in the methane flash drums and eventually degrade performance of the feed gas chillers.

Therefore, a need exists for reducing accumulation of heavies and increasing refrigerant efficiency in closed loop LNG systems which utilize a feed gas stream containing heavy components.

SUMMARY OF THE INVENTION

The present invention overcomes the above-mentioned and other shortcomings by providing a novel and improved method, system, and device that meet the aforementioned needs.

In an embodiment of the present invention, a method for liquefying natural gas, the method includes the steps of: (a) cooling a natural gas stream in a first refrigeration cycle employing a first refrigerant, wherein the first refrigeration cycle includes a plurality of cooling stages; (b) downstream of the first refrigeration cycle, further cooling the natural gas stream in a final refrigeration cycle employing a final refrigerant, wherein the final refrigerant is predominately comprises less than 10 mole percent nitrogen, wherein the final refrigeration cycle includes a plurality of cooling stages, wherein the plurality of cooling stages includes a first cooling stage and a final cooling stage, wherein the temperature of the final refrigeration cycle operates at a lower temperature than the temperature of the first refrigeration cycle; (c) delivering the natural gas stream to a storage tank, wherein evaporation of a portion of the natural gas stream occurs within the storage tank resulting in a boil-off gas; (d) compressing at least a portion of the boil-off gas; and (e) delivering at least a portion of the compressed boil-off gas to the final cooling stage of the final refrigeration cycle, wherein at least a portion of the compressed boil-off gas serves as the final refrigerant in the final cooling stage of the final refrigeration cycle.

In another embodiment of the present invention, a method for liquefying natural gas, the method includes the steps of: (a) cooling a natural gas stream in a first refrigeration cycle employing a first refrigerant, wherein the first refrigeration cycle includes a plurality of cooling stages; (b) downstream of the first refrigeration cycle, further cooling the natural gas stream in a final refrigeration cycle employing a final refrigerant, wherein the final refrigeration cycle includes a plurality of cooling stages; (c) delivering the natural gas stream to a storage tank, wherein evaporation of a portion of the natural gas stream occurs within the storage tank resulting in a boil-off gas; (d) compressing at least a portion of the boil-off gas; and (e) delivering at least a portion of the compressed boil-off gas to the final cooling stage of the final refrigeration cycle, wherein at least a portion of the compressed boil-off gas serves as the final refrigerant in the final cooling stage of the final refrigeration cycle.

In yet another embodiment of the present invention, a system for liquefying natural gas, the system includes: (a) a first refrigeration cycle for cooling a natural gas stream employing a first refrigerant, wherein the first refrigeration cycle includes a plurality of cooling stages; (b) a final refrigeration cycle for cooling the natural gas stream employing a final refrigerant, wherein the final refrigeration cycle includes a plurality of cooling stages; (c) a storage tank for storing the natural gas, wherein evaporation of a portion of the natural gas stream within the storage tank results in a boil-off stream; and (d) a compressor for compressing the boil-off stream, whereby the boil-off stream is delivered to the final refrigeration cycle, and utilizing it as the final refrigerant in the final cooling stage of the final refrigeration cycle.

BRIEF DESCRIPTION OF THE DRAWINGS

The present invention is shown by way of example and not by limitation in the accompanying figures, in which.

DETAILED DESCRIPTION OF THE INVENTION

Figure 1:
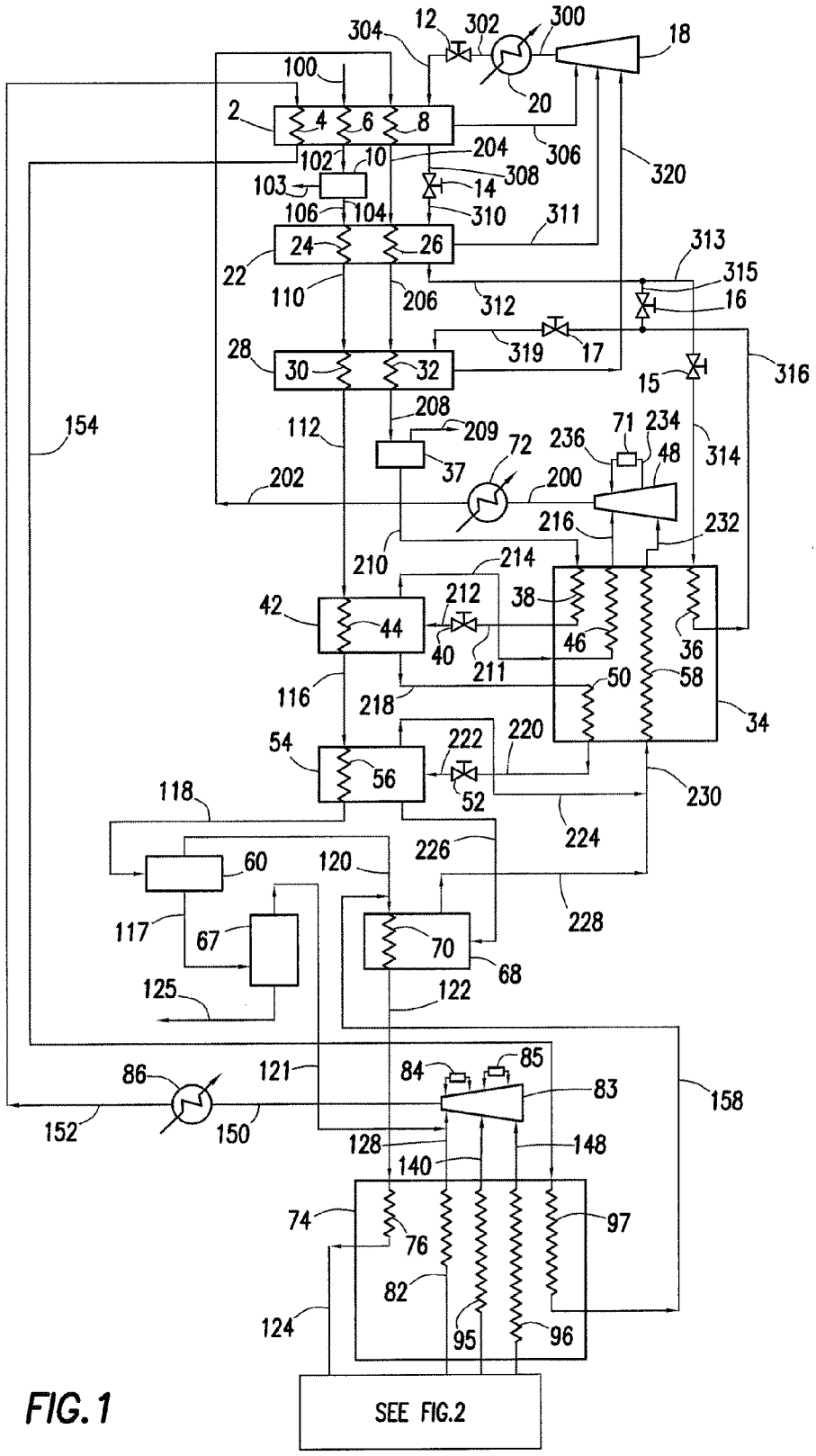
FIG. 1 is a simplified flow diagram of a cascade LNG refrigeration process in accord with an embodiment of the present invention.

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

A cascade refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascade refrigeration process involves the balancing of thermodynamic efficiencies and capital costs. In heat transfer processes, thermodynamic irreversibilities are reduced as the temperature gradients between heating and cooling fluids become smaller. However, obtaining such small temperature gradients generally requires (1) significant increases in the amount of heat transfer area; (2) major modifications to various process equipment; and (3) the proper selection of flowrates through such equipment so as to ensure both flowrates, approach temperatures and outlet temperatures are compatible with the required heating/cooling duty.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane or propylene cycle, a multistage ethane or ethylene cycle, and an open-loop methane cycle which utilizes a portion of the feed gas as a source of methane and which includes therein a multistage expansion cycle to further cool the same and reduce the pressure to near-atmospheric pressure. In another embodiment, the methane cycle can be a closed loop system. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

In cryogenic processing of a natural gas stream an important consideration is contamination. The raw natural gas feed stream suitable for the process of the invention may comprise natural gas obtained from a crude oil well (associated gas) or from a gas well (non-associated gas). The composition of natural gas can vary significantly. While methane is the major desired component of natural gas streams, the typical raw natural gas stream also contains ethane ($C_2$), higher hydrocarbons ($C_3$+), and minor amounts of contaminants such as water, carbon dioxide, hydrogen sulfide, nitrogen, butane, hydrocarbons of six or more carbon atoms, dirt, iron sulfide, wax, and crude oil. The solubilities of these contaminants vary with temperature, pressure, and composition. At cryogenic temperatures, $CO_2$, water, and other contaminants can form solids, which can plug flow passages in cryogenic heat exchangers.

Various pretreatment steps provide a means for removing undesirable components, such as acid-gases, mercaptan, mercury, and moisture from the natural gas feed stream delivered to the LNG facility. The composition of this natural gas stream may vary significantly. As used herein, a natural gas stream is any stream principally comprised of methane which originates in major portion from a natural gas feed stream, such feed stream for example containing at least 85 percent methane by volume, with the balance being ethane, higher hydrocarbons, nitrogen, carbon dioxide and minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-exclusive listing of some of the available means which are readily available to one skilled in the art: (a) acid gases and to a lesser extent mercaptan are routinely removed via a sorption process employing an aqueous amine-bearing solution; (b) a major portion of the water is routinely removed as a liquid via two-phase gas-liquid separation following gas compression and cooling upstream of the initial cooling cycle and also downstream of the first cooling stage in the initial cooling cycle; (c) mercury is routinely removed via mercury sorbent beds; and (d) residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The natural gas feed stream temperature is typically near ambient to slightly above ambient. A representative temperature range being 60° F. to 138° F.

As previously noted, the natural gas feed stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The natural gas feed stream is preferably passed through an effective number of refrigeration stages, nominally two, preferably two to four, and more preferably three stages, in the first refrigeration cycle, also referred herein as the first cooling cycle, utilizing a first refrigerant having relatively high boiling refrigerant. Such refrigerant is preferably comprised in major portion of propane, propylene or mixtures thereof, more preferably the refrigerant comprises at least about 75 mole percent propane, even more preferably at least 90 mole percent propane, and most preferably the refrigerant consists essentially of propane.

Thereafter, the processed natural gas feed stream flows through an effective number of stages, nominally two, preferably two to four, and more preferably two or three, in a second refrigeration cycle, also referred herein as the second cooling cycle, in heat exchange with a second refrigerant having a lower boiling point. Such refrigerant is preferably comprised in major portion of ethane, ethylene or mixtures thereof, more preferably the refrigerant comprises at least about 75 mole percent ethylene, even more preferably at least 90 mole percent ethylene, and most preferably the refrigerant consists essentially of ethylene. As previously noted, the processed natural gas feed stream is combined with one or more recycle streams at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the pretreated natural gas feed stream of the first stage of the first cycle.

Thereafter, the processed natural gas feed stream flows through an effective number of stages, nominally two, preferably two to four, and more preferably three, in a final refrigeration cycle in indirect heat exchange with a final refrigerant. The final refrigerant consists essentially of methane. In a particularly preferred embodiment, the predominately methane refrigerant comprises less than 10 mole percent nitrogen, most preferably less than 5 mole percent nitrogen. Each cooling stage comprises a separate cooling zone.

Generally, the natural gas feed stream will contain such quantities of $C_2$+ components so as to result in the formation of a $C_2$+ rich liquid in one or more of the cooling cycles. This liquid is removed via gas-liquid separation means, preferably one or more conventional gas-liquid separators. Generally, the sequential cooling of the natural gas stream in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operations. The $C_2$+ hydrocarbon stream or streams may be demethanized via a single stage flash or a fractionation column. In the latter case, the resulting natural gas stream can be directly returned at pressure to the liquefaction process. In the former case, this natural gas stream can be repressurized and recycled or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (e.g., $C_2$, $C_3$, $C_4$ and $C_5$+).

The liquefaction process may use one of several types of cooling which include but is not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

Referring to FIG. 1, a feed gas stream, as previously described, is introduced to the system through conduit 100. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative temperature and pressure of the liquefied propane refrigerant prior to flashing is about 100°

F. and about 190 psia. Although not illustrated in FIG. 1, it is preferable that a separation vessel be located downstream of cooler 20 and upstream of expansion valve 12 for the removal of residual light components from the liquefied propane. Such vessels may be comprised of a single-stage gas liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is passed through conduit 302 to a pressure reduction means such as an expansion valve 12 wherein the pressure of the liquefied propane is reduced thereby evaporating or flashing a portion thereof. The resulting two-phase product then flows through conduit 304 into high-stage propane chiller 2 wherein indirect heat exchange with gaseous methane refrigerant introduced via conduit 152, natural gas feed introduced via conduit 100 and gaseous ethylene refrigerant introduced via conduit 202 are respectively cooled via indirect heat exchange means 4, 6 and 8 thereby producing cooled gas streams respectively produced via conduits 154, 102 and 204.

The flashed propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to chiller 22 through conduit 310 thereby providing a coolant for chiller 22.

The cooled feed gas stream from chiller 2 flows via conduit 102 to a knock-out vessel 10 wherein gas and liquid phases are separated. The liquid phase which is rich in $C_3$+ components is removed via conduit 103. The gaseous phase is removed via conduit 104 and conveyed to propane chiller 22. Ethylene refrigerant is introduced to chiller 22 via conduit 204. In the chiller, the natural gas and ethylene refrigerant streams are respectively cooled via indirect heat transfer means 24 and 26 thereby producing cooled natural gas and ethylene refrigerant streams via conduits 110 and 206. The evaporated portion of the propane refrigerant is separated and passed through conduit 311 to the intermediate-stage inlet of compressor 18.

As illustrated in FIG. 1, the natural gas stream flows from the intermediate-stage propane chiller 22 to the low-stage propane chiller/condenser 28 via conduit 110. In this chiller, the stream is cooled via indirect heat exchange means 30. In a like manner, the ethylene refrigerant stream flows from the intermediate stage propane chiller 22 to the low-stage propane chiller/condenser 28 via conduit 206. In the latter, the ethylene-refrigerant is condensed via an indirect heat exchange means 32 in nearly its entirety. The vaporized propane is removed from the low-stage propane chiller/condenser 28 and returned to the low-stage inlet at the compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1, the natural gas stream exiting the low-stage propane chiller is introduced to the high-stage ethylene chiller 42 via conduit 112. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant via conduit 210 then flows to the ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to the high-stage ethylene chiller 42 via conduit 212. Vapor is removed from this chiller via conduit 214 and routed to the ethane economizer 34 wherein the vapor functions as a coolant via indirect heat exchange means 46. The ethylene vapor is then removed from the ethylene economizer via conduit 216 and feed to the high-stage inlet on the ethylene compressor 48. The ethylene refrigerant which is not vaporized in the high-stage stage ethylene chiller 42 is removed via conduit 218 and returned to the ethylene economizer 34 for further cooling via indirect heat exchange means 50, removed from the ethylene economizer via conduit 220 and flashed in a pressure reduction means illustrated as expansion valve 52 whereupon the resulting two-phase product is introduced into the low-stage ethylene chiller 54 via conduit 222. The natural gas stream is removed from the high-stage ethylene chiller 42 via conduit 116 and directly fed to the low-stage ethylene chiller 54 wherein it undergoes additional cooling and partial condensation via indirect heat exchange means 56. The resulting two-phase stream then flows via conduit 118 to a two phase separator 60 from which is produced a natural gas vapor stream via conduit 120 and via conduit 117, a liquid stream rich in $C_2$+ components which is subsequently flashed or fractionated in vessel 67 thereby producing via conduit **125*a* heavies stream and a second natural gas stream which is transferred via conduit 121 and after combination with a second stream via conduit 128 is fed to the high pressure inlet port on the methane compressor 83. The stream in conduit 120 and the stream in conduit 158 which contains a cooled compressed methane recycle stream are combined and fed to the low-stage ethylene condenser 68 wherein this exchanger heats via indirect heat exchange means 70 with the liquid effluent from the low-stage ethylene chiller 54 which is routed to the low-stage ethylene condenser 68 via conduit 226. In condenser 68, combined streams respectively provided via conduits 120 and 158 are condensed and produced from condenser 68 via conduit 122. The vapor from the low-stage ethylene chiller 54 via conduit 224 and low-stage ethylene condenser 68 via conduit 228 are combined and routed via conduit 230 to the ethylene economizer 34 wherein the vapors function as a coolant via indirect heat exchange means 58. The stream is then routed via conduit 232 from the ethylene economizer 34 to the low-stage side of the ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from the cooler flows via conduit 202 and is introduced, as previously discussed, to the high-stage propane chiller 2**.

Figure 2:
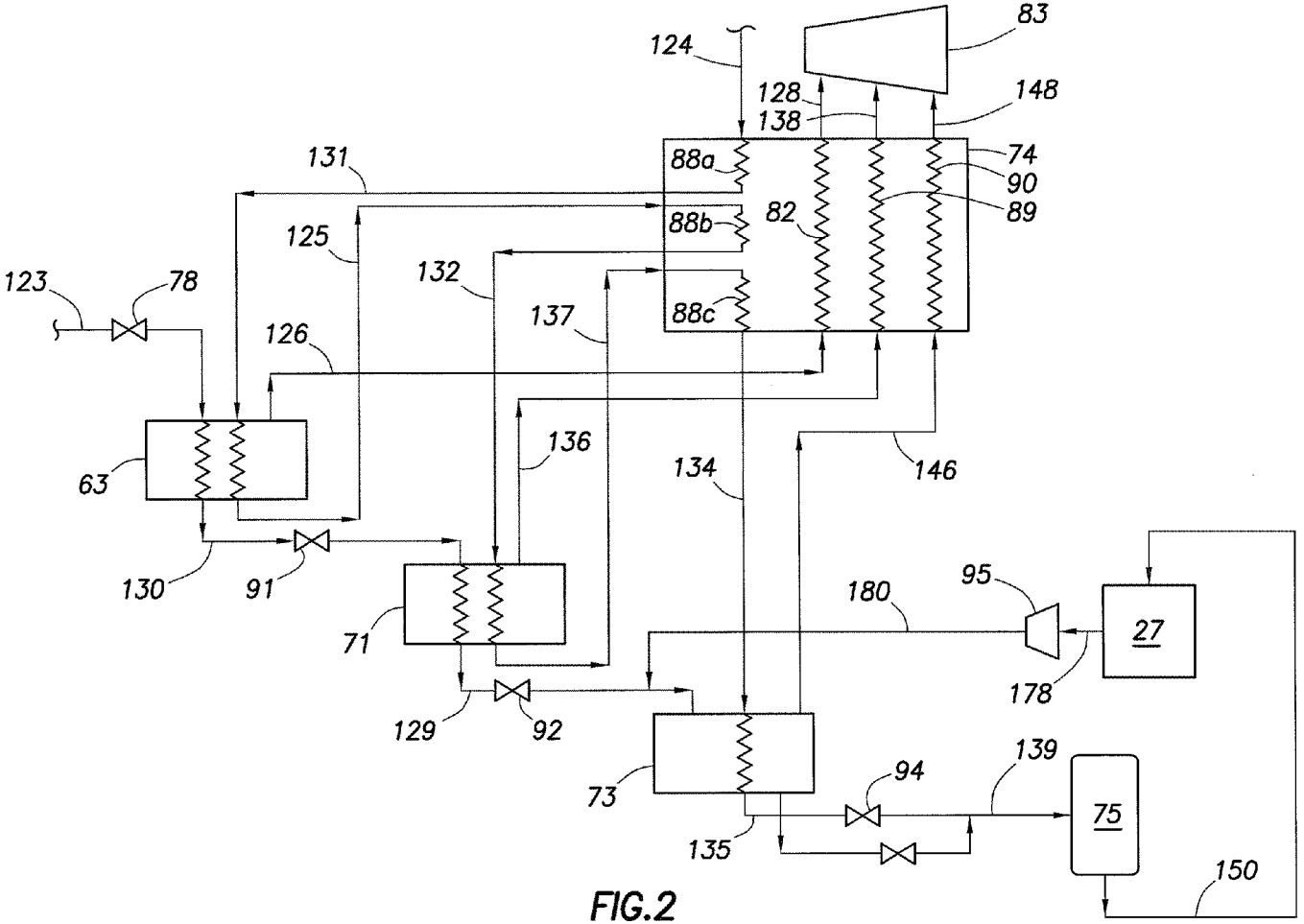
FIG. 2 is a flow diagram detailing the methane refrigeration system of the cascade LNG refrigeration process utilizing boil-off gas in accord with an embodiment of the present invention.
Figure 3:
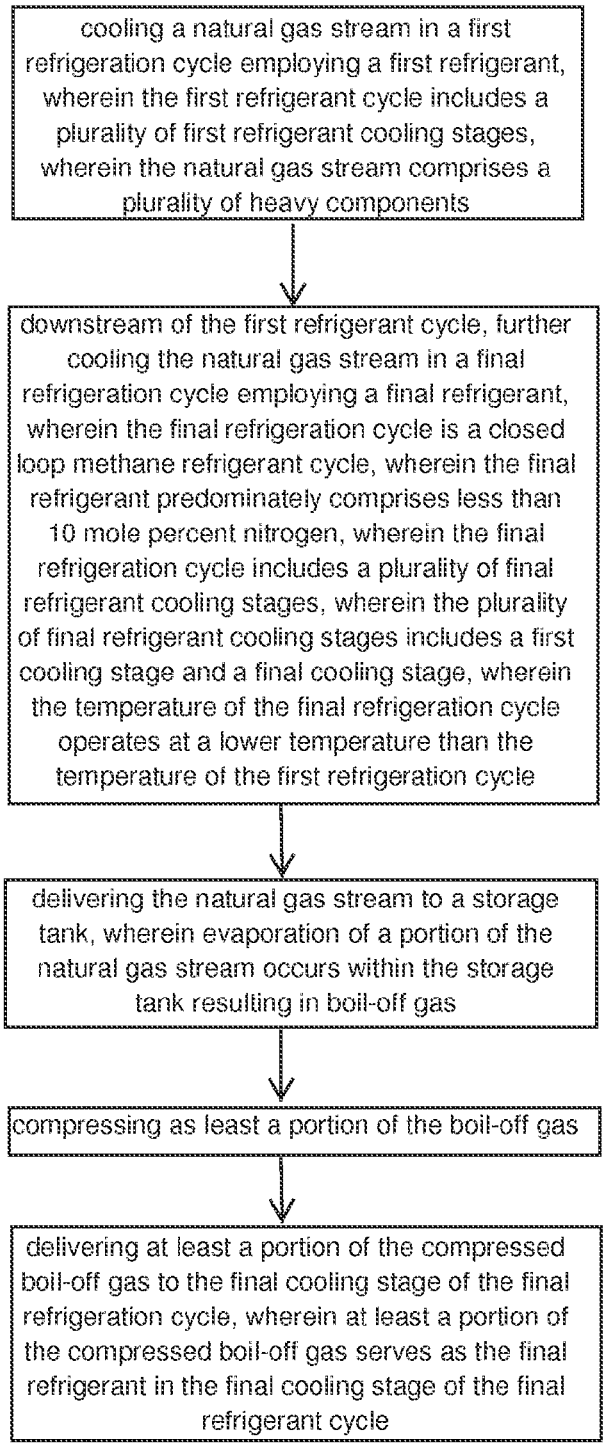
FIG. 3 is a flow chart illustrating a method of processing liquefied natural gas in accordance with an aspect of an exemplary embodiment.

Referring to FIG. 2, the natural gas stream in conduit 122 is generally at a representative temperature and pressure of about −125° F. and about 600 psi. This stream passes via conduit 122 through the main methane economizer 74 wherein the stream is further cooled by indirect heat exchange means 88*a*. The stream exits main methane economizer 74 via conduit 131 and is then introduced to first methane heat exchanger 63 wherein the stream undergoes indirect heat exchange with a methane refrigerant stream in conduit 123. Prior to entry into the first methane heat exchanger 63 the predominately methane refrigerant stream in conduit 123 is introduced to a pressure reduction means such as expansion valve 78 wherein the pressure of the predominately methane refrigerant is reduced thereby evaporating or flashing a portion thereof resulting in a two-phase stream. The two-phase predominately methane refrigerant is then introduced to the first methane heat exchanger 63.

Upon entering the first methane heat exchanger 63 and undergoing indirect heat exchange, the two-phase predominately methane refrigerant exits the heat exchanger as a gas-phase methane predominately methane stream via conduit 126 and a liquid phase predominately methane refrigerant via conduit 130. The gas phase predominately methane refrigerant exits first methane heat exchanger 63 via conduit 126 and is introduced to main methane economizer 74 wherein the stream is further cooled by indirect heat exchange means 82. The predominately methane refrigerant stream exits main methane economizer 74 via conduit 128 and is introduced to high stage methane compressor 83. The liquid phase predominately methane refrigerant exits first methane heat exchanger 63 via conduit 130 and is subsequently introduced to pressure reduction means such as expansion valve 91 wherein the pressure of the predominately methane refrigerant is reduced thereby evaporating or flashing a portion thereof resulting in a two-phase predominately methane refrigerant. The two-phase predominately methane refrigerant is then introduced to the second methane heat exchanger 71.

The cooled natural gas stream exits first methane heat exchanger 63 and is introduced to main methane economizer 74 via conduit 125. The cooled natural gas stream is cooled via indirect heat exchange means 88*b*. The cooled natural gas stream is then passed to second methane heat exchange 71 via conduit 132.

The natural gas stream exiting the main methane economizer 74 in conduit 132 then flows to the second methane heat exchanger 71 wherein it is cooled via indirect heat exchange with the two-phase predominately methane refrigerant originating from conduit 130. The two-phase predominately methane refrigerant includes a gas phase and a liquid phase. The gas phase predominately methane refrigerant is discharged from the second methane heat exchanger 71 via conduit 136, while the liquid phase predominately methane refrigerant is discharged from the second methane heat exchanger 71 via conduit 129. The gas phase predominately methane refrigerant in conduit 136 is introduced into main economizer 74 wherein it is cooled via indirect heat exchange means 89. The resulting predominately methane refrigerant exits main economizer 74 via conduit 138 and is introduced to high stage methane compressor 83. The liquid phase predominately methane refrigerant undergoes pressure reduction means such as expansion valve 92 wherein the pressure of the predominately methane refrigerant is reduced thereby evaporating or flashing a portion thereof resulting in a two-phase predominately methane refrigerant. The two-phase predominately methane refrigerant is then introduced to the third methane heat exchanger 73.

The natural gas stream discharged from second methane heat exchanger 71 via conduit 137 is introduced to main methane economizer 74 wherein it is further cooled via indirect heat exchange means 88*c* with predominately methane refrigerant. The natural gas stream cooled via indirect heat exchange means 88*c* in main economizer 74 is then passed to the third methane heat exchanger 73 via conduit 134.

The two-phase predominantly methane refrigerant is introduced into third methane heat exchanger 73 via conduit 129. The natural gas stream is further cooled by indirect heat exchange with the predominately methane refrigerant. The two-phase predominately methane refrigerant exits the heat exchanger as a gas phase predominately methane refrigerant in conduit 146 and a liquid phase predominately methane refrigerant in conduit 135. The gaseous predominately methane refrigerant in conduit 146 is introduced into main methane economizer 74 wherein it is employed in indirect heat exchange means 90 and subsequently exits main methane economizer 74 via conduit 148 and is carried to high stage methane compressor 83.

The natural gas stream cooled in indirect heat exchange is discharged from third methane heat exchanger 73 via conduit 135 and is flashed in pressure reducing means 94. The flashed stream is then introduced into separator vessel 75 via conduit 139. Separator vessel 75 is operable to separate the predominately liquid and predominately gas phases of the stream introduced via conduit 139. Liquefied natural gas exits separator 75 via conduit 150. The liquefied natural gas product from separator vessel 75, which is at approximately atmospheric pressure, is passed through conduit 150 to a liquefied natural gas storage tank 27. In liquefied natural gas storage tank 27, "boil-off" vapors from the liquefied natural gas are then removed from liquefied natural gas storage tank 27 via conduit 178. The boil off stream in conduit 178 is flashed in a compressor 95, which is then delivered to the third methane heat exchange 73 via the flashed methane refrigerant 129.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. A process for liquefying natural gas, said process comprising the steps of:

a. cooling a natural gas stream in a first refrigeration cycle employing a first refrigerant, wherein the first refrigerant cycle includes a plurality of first refrigerant cooling stages, wherein the natural gas stream comprises a plurality of heavy components;

b. downstream of the first refrigerant cycle, further cooling the natural gas stream in a final refrigeration cycle employing a final refrigerant, wherein the final refrigeration cycle is a closed loop methane final refrigerant cycle, wherein the final refrigerant predominately comprises less than 10 mole percent nitrogen, wherein the final refrigeration cycle includes a plurality of final refrigerant cooling stages, wherein the plurality of final refrigerant cooling stages includes a first cooling stage and a final cooling stage, wherein the temperature of the final refrigeration cycle operates at a lower temperature than the temperature of the first refrigeration cycle;

c. delivering the natural gas stream to a natural gas product storage tank, wherein evaporation of a portion of the natural gas stream occurs within the natural gas product storage tank resulting in boil-off gas;

d. compressing as least a portion of the boil-off gas; and e. delivering at least a portion of the compressed boil-off gas from the natural gas product storage tank to the final cooling stage of the closed loop methane final refrigeration cycle, wherein at least a portion of the compressed boil-off gas serves as the final refrigerant in the final cooling stage of the closed loop methane refrigerant final refrigerant cycle.

2. The process according to claim 1, wherein the plurality of first refrigerant cooling stages in the first refrigeration cycle comprises 2 to 4 cooling stages.

3. The process according to claim 2, wherein the plurality of first refrigerant cooling stages in the first refrigeration cycle comprises 3 cooling stages.

4. The process according to claim 1, wherein the first refrigerant comprises at least 75 mole percent propane, propylene or mixtures thereof.

5. The process according to claim 4, wherein the first refrigerant comprises at least 90 mole percent propane.

6. The process according to claim 5, wherein the first refrigerant consists essentially of propane.

7. The process according to claim 1, wherein the first refrigerant comprises at least 75 mole percent ethane, ethylene or mixtures thereof.

8. The process according to claim 7, wherein the first refrigerant comprises at least 90 mole percent ethane, ethylene or mixtures thereof.

9. The process according to claim 8, wherein the first refrigerant consists essentially of ethylene.

10. The process according to claim 1, wherein the final refrigerant is predominately methane comprising less than 5 mole percent nitrogen.

11. A process for liquefying natural gas, said process comprising the steps of:

a. cooling a natural gas stream in a first refrigeration cycle employing a first refrigerant, wherein the first refrigeration cycle includes a plurality of first refrigerant cooling stages wherein the natural gas stream comprises a plurality of heavy components;

b. downstream of the first refrigeration cycle, further cooling the natural gas stream in a final refrigeration cycle employing a final refrigerant, wherein the final refrigeration cycle is a closed loop methane refrigeration cycle, wherein the final refrigeration cycle includes a plurality of final refrigerant cooling stages;

c. delivering the natural gas stream to a natural gas product storage tank, wherein evaporation of a portion of the natural gas stream occurs within the natural gas product storage tank resulting in a boil-off gas;

d. compressing at least of portion of the boil-off gas; and e. delivering at least a portion of the compressed boil-off gas from the natural gas product storage tank to the final cooling stage of the closed loop methane refrigerant final refrigeration cycle, wherein at least a portion of the compressed boil-off gas serves as the final refrigerant in the final cooling stage of the closed loop methane refrigerant final refrigeration cycle.

12. The process according to claim 11, wherein the final refrigeration cycle operates at a lower temperature than the first refrigeration cycle.

13. The process according to claim 11, wherein the plurality of first refrigerant cooling stages in the first refrigeration cycle comprises 2 to 4 cooling stages.

14. The process according to claim 13, wherein the plurality of first refrigerant cooling stages in the first refrigeration cycle comprise 3 cooling stages.

15. The process according to claim 11, wherein the first refrigerant comprises at least 75 mole percent propane, propylene or mixtures thereof.

16. The process according to claim 15, wherein the first refrigerant comprises at least 90 mole percent propane.

17. The process according to claim 16, wherein the first refrigerant consists essentially of propane.

18. The process according to claim 11, wherein the first refrigerant comprises at least 75 mole percent ethane, ethylene or combinations thereof.

19. The process according to claim 18, wherein the first refrigerant comprises at least 90 mole percent ethane, ethylene or combinations thereof.

20. The process according to claim 19, wherein the first refrigerant consists essentially of ethylene.

21. The process according to claim 11, wherein the final refrigerant is predominately methane comprising less than 10 mole percent nitrogen.

22. The process according to claim 21, wherein the final refrigerant is predominately methane comprising less than 5 mole percent nitrogen.

23. The process according to claim 11, wherein the plurality of final refrigerant cooling stages in the final refrigeration cycle comprises 2 to 4 cooling stages.

24. The process according to claim 23, wherein the plurality of final refrigerant cooling stages in the final refrigeration cycle comprises 3 cooling stages.

* * * * *